US005875977A

United States Patent [19]

Kozlak et al.

[11] Patent Number: 5,875,977

[45] Date of Patent: Mar. 2, 1999

[54] TECHNIQUE FOR IMPROVING THE RESPONSE TIME OF PULVERIZED COAL BOILERS

[75] Inventors: Martin J. Kozlak, Enfield; Reed S. C. Rogers, Avon; Gregory R. Strich, Enfield, all of Conn.

[73] Assignee: Combustion Engineering, Inc., Windsor, Conn.

[21] Appl. No.: 76,986

[22] Filed: May 13, 1998

[51] Int. Cl.[6] ..... B02C 25/00

[52] U.S. Cl. ..... 241/18; 241/19; 241/29; 241/34; 241/52; 241/53; 241/79.1; 241/107

[58] Field of Search ..... 241/18, 19, 27, 241/29, 30, 33, 34, 48, 52, 53, 61, 79, 79.1, 80, 97, 107

[56] References Cited

U.S. PATENT DOCUMENTS

| | | | |
|---|---|---|---|
| 2,831,637 | 4/1958 | Mittendorf et al. | 110/106 |
| 3,092,337 | 6/1963 | Patterson | 241/34 |
| 4,184,640 | 1/1980 | Williams | 241/34 |
| 4,518,123 | 5/1985 | Tanaka et al. | 241/18 |
| 4,640,464 | 2/1987 | Musto et al. | 241/34 |
| 4,684,069 | 8/1987 | Hashimoto et al. | 241/79.1 |
| 4,915,306 | 4/1990 | Peet | 241/18 |
| 5,383,612 | 1/1995 | Williams | 241/34 |
| 5,386,945 | 2/1995 | Nose et al. | 241/30 |
| 5,603,268 | 2/1997 | Kinoshita et al. | 110/342 |

*Primary Examiner*—John M. Husar
*Attorney, Agent, or Firm*—Arthur E. Fournier, Jr.

[57] ABSTRACT

A method of controlling the operation of the bowl mills in a coal-fired steam generating power plant is disclosed; and in particular a method of controlling the operation of such bowl mills such that the furnace of a steam generating power plant can more rapidly respond to abrupt changes in the demands placed upon the output of the furnace due to abrupt changes in the power requirements of an electric power grid.

11 Claims, 5 Drawing Sheets

TECHNIQUE FOR IMPROVING THE RESPONSE TIME OF PULVERIZED COAL BOILERS

BACKGROUND OF THE INVENTION

This invention relates to a method of controlling the operation of the bowl mills in a coal-fired steam generating power plant and in particular to a method of controlling the operation of such bowl mills such that the furnace of a steam generating power plant can more rapidly respond to abrupt changes in the demands placed upon the output of the furnace due to the abrupt changes in the power requirements of an electric power grid.

It has long been known in the prior art to provide apparatus for purposes of effecting the grinding or pulverizing of certain materials. More specifically, the prior art is replete with examples of various types of apparatus that have been used to effect such grinding of a multiplicity of materials. Coal is one such material wherein there is a need that it be ground to a particular fineness in order to render it suitable for the use in, for example, a fossil fuel(i.e., coal)-fired steam generating power plant.

For purposes of the discussion that follows, the coal-fired steam generating power plant referred to above is considered to consist of essentially the following major operating components: a coal feeder, apparatus for pulverizing the coal, a distribution system for distributing the pulverized coal, a furnace to which the pulverized coal is to be distributed and in which in it is to be burned and the requisite controls to effect the proper operation of the coal-fired steam generating power plant. Of particular interest herein is that portion of the steam generating power plant known as the coal pulverizer. Coal pulverizers are not new. They have been known to exist in the prior art for more than half a century. Furthermore, many improvements in the construction and/or mode of operation of coal pulverizing have been made during this period.

One particular type of coal pulverizing apparatus which is to be found in the prior art is that which is most commonly known in the industry as a bowl mill. The bowl mill gets its name from the fact that the pulverization, i.e., the grinding of the coal to a particular fineness, is accomplished on a grinding surface that bears resemblance to a bowl. Reference may be had, by way of exemplification and as a means of teaching the nature of the construction and the mode of operation of a prior art bowl mill suitable for use in a coal-fired steam generating power plant, to U.S. Pat. No. 3,465,971 which has been assigned to the same assignee as the present application. As taught by the aforementioned patent, a bowl mill consists of essentially the following major operating components: a separator body in which the bowl shaped grinding surface, i.e., a grinding table is mounted for rotation, a plurality of grinding rollers that cooperate interactively with the grinding table to effect the grinding of coal interposed therebetween, a coal supply means for supplying to the interior of the bowl mill the raw, untrammeled coal that is to be pulverized and an air supply means for supplying, also to the interior of the bowl mill, the air required for entrainment of pulverized coal of a certain fineness.

In accordance with the mode of operation of such a bowl mill, the coal, which is to be ground to a particular fineness, is introduced into the central portion of the bowl mill from above. A first pulverizing of the coal is accomplished by virtue of the cooperative interaction of the grinding table and a plurality of grinding rollers. The grinding table is made to rotate about a vertical axis, central to the separator body, while the grinding rollers are each freely rotatable about its own axis. The grinding rollers are suspended within the separator body so as to exert pressure, either by mechanical means or due to their own massive weight, against the grinding table and the coal trapped therebetween, thus effecting the pulverization of the coal. The grinding rollers are made to rotate by the mutual contact of the coal being pulverized with the grinding rollers and the rotating grinding table. The periphery of the grinding table is spaced from the interior of the walls of the separator body so as to provide an annular passage therebetween. Pressurized air, commonly known as primary air, is admitted to the lower portion of the separator body from beneath the grinding table so as to create an upwardly mobile stream of air flowing through and about the annular passage by way of a multiplicity of annular spaces formed between the periphery of the grinding table and the inner wall of the separator body. The annular spaces cause the primary air stream to flow over the grinding table. After the first pulverizing action, the coal particles are thrown outwardly from the grinding table by the effect of noninertial (i.e., centrifugal) forces. This initially ground coal contains a range of very coarse to very fine coal particles and is entrained by the primary air stream after the primary air stream passes through the annular spaces. In addition, the primary air stream must maintain a minimum velocity in order to adequately entrain coal particles of a certain fineness. Thus, there is a first stage separation of the coarsest (and therefore heaviest) coal particles from the primary air stream. These coal particles are immediately returned to the grinding table to undergo a second pulverizing action. The primary air stream, containing still relatively coarse and relatively fine coal particles, continues to flow upwardly within the separator body, thence through a convoluted path that acts to further separate still relatively coarse (and therefore still heavier) coal particles from the primary air stream in a second stage. These particles are also returned to the grinding table to suffer a second pulverizing action. However, coal particles of a particular fineness remain entrained within the primary air stream and are carried through the remainder of the bowl mill. These particles finally exit the bowl mill and are delivered to the furnace of the steam generating power plant for combustion therein. The action of a first grinding of the coal, followed by initial entrainment of some coal particles within the primary air stream, followed by the first and second stage separation of the coarser coal particles from the primary air stream, followed by the return of those coarser coal particles for a second grinding is a cycle that may be repeated several times before a particle of coal is reduced to sufficient fineness so as to be carried through the bowl mill and delivered to the furnace. As a consequence of this cyclic action there is a buildup of coal particles within the bowl mill during its steady state operation. Such buildup of coal particles is herein referred to as a slug and will be addressed in more detail below.

Of more particular interest is the means by which the aforesaid second stage separation of the more coarsely ground coal particles from the primary air stream is effected. The means by which this separation is generally accomplished is by way of a static classifier or a rotary classifier. In a static classifier the flow of primary air combined with those coal particles still entrained therein is directed through a series of stationary turning vanes which make up the aforesaid convoluted path. Said turning vanes are canted at an angle to the direction of the flow of the stream of primary air and coal particles so as to cause the coarsest (and therefore heaviest particles) to fall out of the primary air stream and return to the grinding table to suffer a second pulverizing action. In a rotary classifier the flow of primary air combined with those coal particles still entrained therein is directed through a series of vanes disposed as an inverted, truncated cone and revolving about the central vertical axis of the housing at a predetermined rotational velocity in a squirrel cage fashion. The vanes are canted at an angle to the direction of the flow of the stream of primary air and coal particles entrained therein so as to present to the stream a window through which the stream of primary air and coal particles may pass unimpeded. However, the rotational velocity of the vanes coupled with the velocity of the primary air stream and the coal particles entrained therein acts to separate the coal particles into two groups. A first group of particles are those that are relatively coarse or heavy and therefore unable to pass unimpeded through the aforesaid window and are thus returned to the grinding table to suffer a second pulverizing action. A second group of particles are those that are relatively fine or light and therefore able to pass unimpeded through the window and thus be directed through the remainder of the bowl mill and delivered to the furnace of the steam generator. For a fixed velocity of the primary air stream, by the judicious manipulation and control of the aforesaid rotational velocity of the vanes, the relative fineness of the two groups of coal particles may be adjusted, i.e., by increasing the rotational velocity of the vanes, the fineness of the coal particles that pass through the aforesaid window increases. In other words only increasingly finer particles will pass unimpeded as rotational velocity increases whereas increasingly coarser coal particles will pass unimpeded as rotational velocity is reduced. Conversely, for a fixed rotational velocity of the vanes, by the judicious manipulation and control of the aforesaid velocity of the primary air stream, the relative fineness of the two groups of coal particles may be adjusted, i.e., by increasing the velocity of the primary air stream, the fineness of the coal particles that pass through the aforesaid window increases. In other words finer and finer particles will pass unimpeded as primary air velocity increases and coarser and coarser coal particles will pass unimpeded as primary air velocity is reduced.

Bowl mills can be characterized by two important variables-fineness and throughput. Fineness is the cumulative percentage of the mass of a sample of particles distributed over a series of successively more restrictive standard mesh screens. According to one fineness classification method, mesh sizes range from #4 which indicates 4 openings per inch or 16 openings per square inch to #400 which indicates 400 openings per inch or 160,000 openings per square inch. A #200 mesh screen, for example, will allow particles of no greater than 74 microns to pass. Throughput is simply the mass flow rate of raw coal fed to the bowl mill. Furthermore, the operation of classifiers can be characterized by several important relationships. Firstly, the carbon loss suffered by a coal-fired steam generating power plant decays approximately exponentially with an increase in the fineness of the pulverized coal burned in the steam generator. Secondly, fineness declines approximately linearly with increasing throughput; with the performance of a rotary classifier an improvement upon that of a static classifier. Thirdly, in the pulverization of coal, for example, the log percentage of the throughput increases approximately linearly with a reduction in fineness; with the performance of a rotary classifier an improvement upon that of a static classifier. In addition, by increasing the mass flow rate of primary air to the bowl mill, fineness decreases due to the fact that heavier and therefore larger coal particles can be adequately entrained by the primary air stream. Conversely, by decreasing the mass flow rate of primary air to the mill, fineness increases. Also, by increasing the rotational velocity of a rotary classifier, fineness increases. One possible reason for the decrease in the fineness could be that there is now a smaller time interval available between the successive passage of the classifier vanes through which a particle of coal may pass. Conversely, by decreasing the rotational velocity of the rotary classifier, the fineness is decreased.

In a conventional coal-fired steam generating power plant, a multiplicity of bowl mills, of the type described above, would commonly be employed for the purpose of supplying the pulverized coal requirements thereto. As stated above, the pulverizer is an integral component of a steam generating power plant. However, the steam generating power plant is in turn an integral part of a larger electric power system which further includes a turbine/generator set and an electric power grid. In particular, pulverized coal is delivered from the pulverizers to the furnace of the steam generator wherein it is burned in air and, coupled with the working fluid of a thermodynamic steam cycle, superheated and/or reheated steam is produced thereby. The superheated and/or reheated steam is then used as the motive power to rotate a steam turbine. An electric generator, which in known fashion is cooperatively associated with the steam turbine, converts the kinetic energy of the steam turbine into electric power. This electric power is delivered to the electric power grid for consumption therein.

However, the power needs of the electric power grid are variable and may display abrupt changes. This in turn places abrupt changes in the demands placed upon the output of the furnace of a steam generating power plant, which is in turn reflected in the abrupt changes in the demands placed upon the fuel output of the pulverizers of the power plant. As an example, there may be times when the power requirements of the electric power grid increase rapidly. These power requirements are relayed to the operators of the furnace of the steam generating power plant who thereupon demand a correspondingly rapid increase in the fuel output of the pulverizers. Typical of the current methods of increasing the fuel output of the pulverizers to meet such a demand is to increase the rate at which raw, untrammeled coal is fed to the pulverizers coupled with an increase in the mass flow rate of primary air fed to the pulverizers, while allowing the rotational velocity of the rotary classifier to adjust in order to maintain a prescribed fineness profile. However, this is a relatively slow and time consuming method in which the lag time between the demand for more power received from the electric power grid and the concomitant response in an increase in fuel output by the pulverizers may be unacceptably long. Conversely, there may be times when the power requirements of the electric power grid decrease rapidly. These requirements are also relayed to the operators of the furnace of the steam generating power plant who thereupon demand a correspondingly rapid decrease in the fuel output of the pulverizers. Typical of the current methods of decreasing the fuel output of the pulverizers to meet such a demand is to decrease the rate at which raw, untrammeled coal is fed to the pulverizers coupled with a decrease in the mass flow rate of primary air fed to the pulverizers, while allowing the rotational velocity of the rotary classifier to adjust in order to maintain a prescribed fineness profile. However, this is also a relatively slow and time consuming method in which the lag time between demand for less power received from the electric power grid and the concomitant response in a decrease in the fuel output of the pulverizers may also be unacceptably long.

The present invention addresses these problems by providing a method of operating a bowl mill pulverizer such that the furnace of a steam generating power plant can more rapidly respond to abrupt changes in the demands placed upon the output of the furnace due to the abrupt changes in the power requirements of an electric power grid. In particular, the present invention accomplishes this by providing a method of delivering a slug of pulverized coal to the furnace of a steam generating power plant from either a single pulverizer or from a plurality of pulverizers operated simultaneously and in an en banc fashion or from a plurality of pulverizers operated in a sequential fashion beginning with a first bowl mill followed by a second bowl mill and so forth until each bowl mill, or as many bowl mills of the plurality as desired, has been so operated. Furthermore, the present invention accomplishes this by providing a method of withholding a slug of pulverized coal to the furnace of a steam generating power plant from either a single pulverizer or from a plurality of pulverizers operated simultaneously and in an en banc fashion or from a plurality of pulverizers operated in a sequential fashion beginning with a first bowl mill followed by a second bowl mill and so until each bowl mill, or as many bowl mills of the plurality as desired, has been so operated.

U.S. Pat. No. 5,603,268 discloses an improved method and control system for operating a coal pulverizer associated with a rotary classifier, in which current of the motor of the pulverizer can be prevented from exceeding a rated value and thus tripping of the motor can be prevented, while a high efficiency of the operation of a boiler receiving coal from the classifier is maintained. Furthermore, U.S. Pat. No. 5,386,945 discloses a roller mill control method capable of automatically controlling a roller mill which is difficult to control, and a controller for carrying out the roller mill control method. Also, U.S. Pat. No. 4,915,306 discloses a technique wherein the technique for the control of a pulverizer in a coal-fired steam generator plant is achieved by the use of a "coordination curve" which relates the primary air flow to the pulverizer with the required mass flow of coal through the pulverizer. U.S. Pat. No. 4,684,069 discloses a classifier and its controller, the classifier being operable in a vertical mill, for example, to guide a powdery material by means of a gas flow, and to selectively draw off a portion of the powdery material according to the particle size of the powdery material. Furthermore, U.S. Pat. No. 4,640,464 discloses a control system operative to control the rate of feed of material to a roller mill in accordance with the output that is being demanded from the roller mill, while yet at the same time ensuring that during changes in the output being demanded from the roller mill both a constant fineness of pulverized material and a constant air-to-solids ratio from the roller mill are being maintained. Also, U.S. Pat. No. 4,518,123 discloses a control system for a pulverizer which is capable of expanding the control range for the coal pulverizing rate, to the greatest extent possible. There is also disclosed, by way of U.S. Pat. No. 4,184,640, a roller mill with a control system wherein the control system is connected in circuit relation with prime mover means, which in turn are connected to the grinding rolls and the classifier means, respectively, of the roller mill. Moreover, U.S. Pat. No. 3,092,337 a system employing an exhauster and which includes an indicator and control system that provides an instantaneous indication of the pulverized material output and control responsive thereto. Furthermore, U.S. Pat. No. 2,831,637 discloses an improved control system for regulating the amount and temperature of air conveying the pulverized fuel from the mill to the burners into the furnace under widely varying operating and load conditions. U.S. Pat. No. 2,564,595 discloses an invention which relates to improvement in means for selectively separating finer from coarser particles of dust like material and particularly to a new and useful improvement in separating devices known as whizzer separators.

Thus, there has been evidenced in the prior art a need for a new and improved method whereby the furnace of a steam generating power plant can be made to more rapidly respond to abrupt changes in the demands placed upon the output of the furnace due to the abrupt changes in the power requirements of an electric power grid.

There has also been evidenced by the prior art a need for a new and improved method of controlling the operation of a bowl mill such that the furnace of a steam generating power plant can more rapidly respond to abrupt changes in the demands placed upon the output of the furnace due to the abrupt changes in the power requirements of an electric power grid.

It is therefore an object of the present invention to provide a new and improved method of controlling the operation of a bowl mill such that the furnace of a steam generating power plant can more rapidly respond to abrupt changes in the demands placed upon the output of the furnace due to the abrupt changes in the power requirements of an electric power grid.

Further, it is an object of the present invention to provide such a new and improved method of controlling the operation of a bowl mill such that the method is capable of simultaneous use in conjunction with each bowl mill of a plurality of bowl mills operating in an en banc fashion.

It is yet further an object of the present invention to provide such a new and improved method of controlling the operation of a bowl mill such that the method is capable of use in conjunction with each bowl mill of a plurality of bowl mills beginning with a first bowl mill and proceeding sequentially therefrom to a second bowl mill and so on until each bowl mill, or as many bowl mills as desired, of the plurality of bowl mills has been so operated.

It is still further an object of the present invention to provide such a new and improved method of controlling the operation of a bowl mill such that the method is capable of use in conjunction with numerous different types of pulverizers.

SUMMARY OF THE INVENTION

In accordance with a first aspect of the present invention, there is provided a method of controlling the operation of at least one bowl mill cooperatively associated with the furnace of a steam generating power plant so as to more rapidly deliver a slug of pulverized coal to the furnace of such a steam generating power plant in response to relatively abrupt increases in the demands placed upon the fuel output of the bowl mill. The method comprises the steps of operating the at least one pulverizer in an initial operating condition so as to establish thereby a first mass flow rate of output pulverized solid fuel delivered to the furnace and a first particle size distribution thereof. This includes feeding raw, untrammeled solid fuel to the at least one pulverizer at an initial average mass flow feed rate for pulverization of the solid fuel in the pulverizer, supplying a gas stream to the at least one pulverizer at an initial average mass flow supply rate, the gas stream entraining at least some of the pulverized solid fuel for flow thereof into engagement with the rotary classifier means for classification thereby and rotating the rotary classifier means at an initial average rotational velocity to classify the pulverized solid fuel between the discharge condition and the non-discharge condition. Furthermore, during a transition period the operation of the at least one pulverizer is changed from the initial operating condition so as to establish thereby a second mass flow rate of output pulverized solid fuel delivered to the furnace and a second particle size distribution thereof. This includes increasing the average mass flow feed rate of the raw, untrammeled solid fuel being fed to the at least one pulverizer to an increased average mass flow feed rate, increasing the average mass flow supply rate of the gas stream being supplied to the at least one pulverizer to an increased average mass flow supply rate and decreasing the average rotational velocity of the rotary classifier means to a decreased average rotational velocity wherein the second mass flow rate of the pulverized solid fuel to the furnace is greater than the first mass flow rate of the pulverized solid fuel to the furnace and the second particle size distribution is such that the second particle size distribution contains a greater percentage of relatively larger particles than the first particle size distribution.

In accordance with a second aspect of the present invention, there is provided a method of operating a plurality of bowl mills, as described with respect to the first aspect of the present invention, such that all of the bowl mills are so operated simultaneously and in an en banc fashion.

In accordance with a third aspect of the present invention, there is provided a method of operating a plurality of bowl mills, as described with respect to the first aspect of the present invention, such that the bowl mills are so operated sequentially beginning with a first bowl mill followed by a second bowl mill and so on until each bowl mill, or as many bowl mills of the plurality as desired, has been so operated in accordance with the method of the present invention.

In accordance with a fourth aspect of the present invention, there is provided a method of controlling the operation of at least one bowl mill cooperatively associated with the furnace of a steam generating power plant so as to more rapidly withhold a slug of pulverized coal to the furnace of such a steam generating power plant in response to relatively abrupt decreases in the demands placed upon the fuel output of the bowl mill. The method comprises the steps of operating the at least one pulverizer in an initial operating condition so as to establish thereby a first mass flow rate of output pulverized solid fuel delivered to the furnace and a first particle size distribution thereof. This includes feeding raw, untrammeled solid fuel to the at least one pulverizer at an initial average mass flow feed rate for pulverization of the solid fuel in the pulverizer, supplying a gas stream to the at least one pulverizer at an initial average mass flow supply rate, the gas stream entraining at least some of the pulverized solid fuel for flow thereof into engagement with the rotary classifier means for classification thereby and rotating the rotary classifier means at an initial average rotational velocity to classify the pulverized solid fuel between the discharge condition and the non-discharge condition. Furthermore, during a transition period the operation of the at least one pulverizer is changed from the initial operating condition so as to establish thereby a second mass flow rate of output pulverized solid fuel delivered to the furnace and a second particle size distribution thereof. This includes decreasing the average mass flow feed rate of the raw, untrammeled solid fuel being fed to the at least one pulverizer to a decreased average mass flow feed rate, decreasing the average mass flow supply rate of the gas stream being supplied to the at least one pulverizer to a decreased average mass flow supply rate and increasing the average rotational velocity of the rotary classifier means to an increased average rotational velocity wherein the second mass flow rate of the pulverized solid fuel to the furnace is less than the first mass flow rate of the pulverized solid fuel to the furnace and the second particle size distribution is such that the second particle size distribution contains a lesser percentage of relatively larger particles than the first particle size distribution.

In accordance with a fifth aspect of the present invention, there is provided a method of operating a plurality of bowl mills, as described with respect to the fourth aspect of the present invention, such that all of the bowl mills are so operated simultaneously and in an en banc fashion.

In accordance with a sixth aspect of the present invention, there is provided a method of operating a plurality of bowl mills, as described with respect to the fourth aspect of the present invention, such that the bowl mills are so operated sequentially beginning with a first bowl mill followed by a second bowl mill and so until each bowl mill, or as many bowl mills of the plurality as desired, has been so operated.

DESCRIPTION OF THE PREFERRED EMBODIMENT

Figure 1:
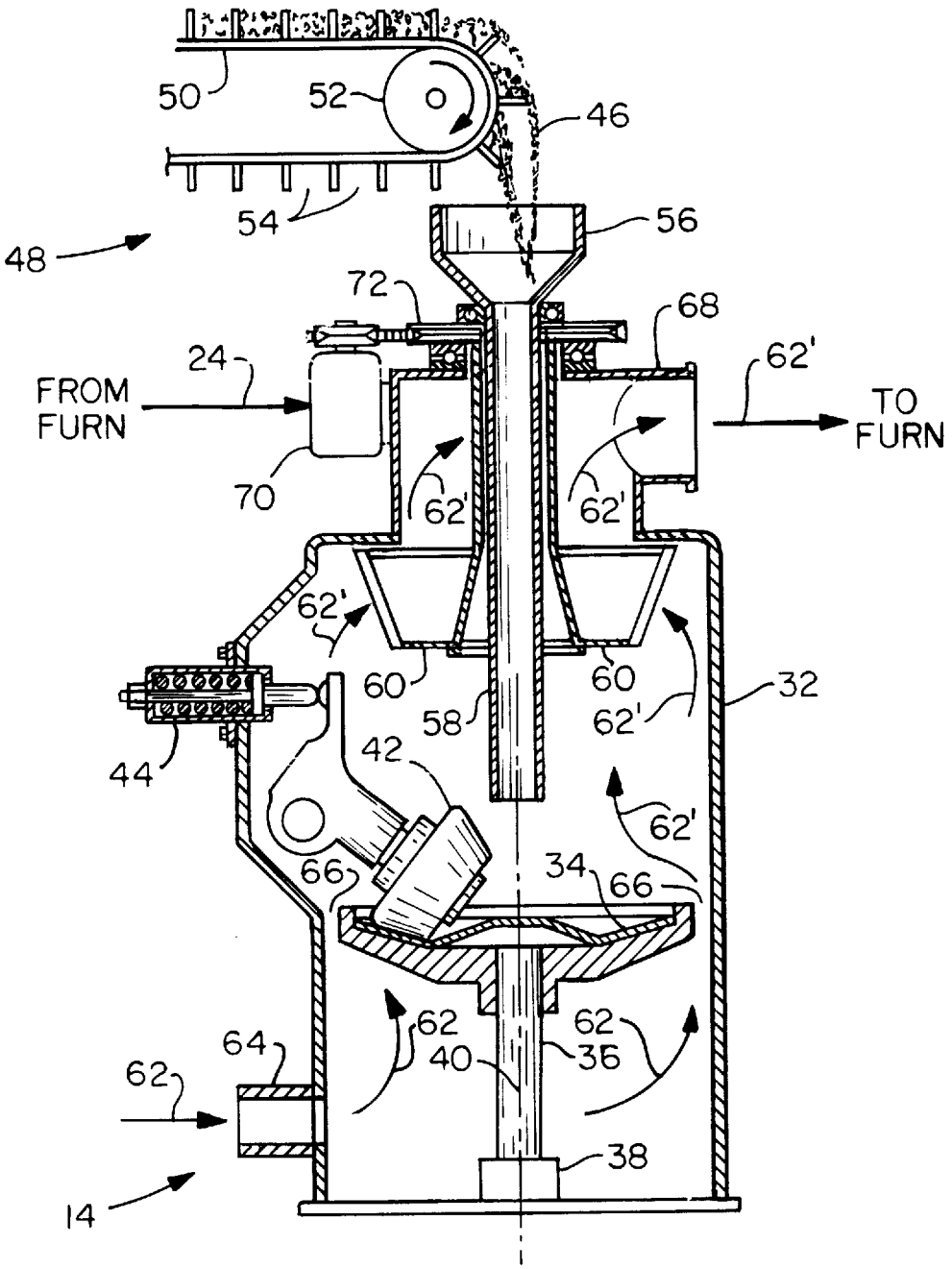
FIG. 1 is a diagrammatic representation of a sectional elevation of a bowl mill capable of use in conjunction with the present invention.

Referring now to FIG. 1, a pulverizing bowl mill 14 is depicted therein cooperatively associated with a coal supply means 48. Inasmuch as the nature of the construction and the mode of operation of a pulverizing bowl mill is well known to those skilled in the art, it is deemed not necessary to set forth a detailed description of the pulverizing bowl mill 14. Rather, it is deemed sufficient for purposes of obtaining an understanding of the pulverizing bowl mill 14 that is capable of use in conjunction with the present invention that there be presented merely a general description of the nature of the construction and the mode of operation of the components of the pulverizing bowl mill 14. For a more detailed description of the nature of the construction and the mode of operation of components of the pulverizing bowl mill 14, which are not described in depth herein, reference is made to U.S. Pat. No. 3,465,971 which issued on Sep. 9, 1969 to J. F. Dalenburg et al. or U.S. Pat. No. 4,002,299, which issued on Jan. 11, 1977 to C. J. Skalka.

Referring further to FIG. 1, the pulverizing bowl mill 14 includes a substantially enclosed circular separator body 32. Furthermore, a circular grinding table 34 is mounted upon a vertical shaft 36, which in turn is operatively connected to a suitable drive mechanism 38 so as to be capable of rotation about a vertical axis 40 central to the separator body 32. With the aforesaid components arranged within the separator body 32 in the manner depicted in FIG. 1, the grinding table 34 is designed to be driven in a clockwise or counterclockwise direction.

Continuing with a description of the pulverizing bowl mill 14, a plurality of grinding rollers 42, preferably three in number in accordance with the best mode of the present invention, are suitably supported within the interior of the separator body 32 so as to be spaced circumferentially and equidistant about the grinding table 34. In the interest of clarity, only one such grinding roller 42 has been shown in FIG. 1. With further regard to the grinding rollers 42, each of the latter, as best understood with reference to FIG. 1, is preferably supported on a suitable shaft (not shown) for rotation thereabout. Further, the grinding rollers 42 are each suitably supported for movement relative to the upper surface of the grinding table 34. To this end, each of the grinding rollers 42 has a spring means 44 cooperatively associated with the separator body 32 to establish a loading on the corresponding grinding roller 42 whereby the grinding roller 42 is made to exert the requisite degree of force upon the grinding table 34 for the purpose of pulverizing any coal trapped therebetween.

Raw, untrammeled coal 46 is to be pulverized in the bowl mill 14 and is fed thereto by means of a belt 50. In accordance with FIG. 1, the belt 50 is an endless belt that is made to pass around a pair of rollers 52, only one of which is shown in FIG. 1. Any suitable conventional drive means (not shown) may be employed for the purpose of imparting rotational drive to the rollers 52 and thus to the endless belt 50. Preferably, as shown in FIG. 1, the endless belt 50 is supplied with a plurality of compartments 54 that extend along the surface of the endless belt 50 and are continuously and repetitively supplied with raw, untrammeled coal 46 from an endless source. It is also to be understood from FIG. 1 that in the course of operation of the coal supply means 48 in conjunction with the bowl mill 14, raw, untrammeled coal 46 is continuously and repetitively fed to the interior of the bowl mill 14 from above via a hopper 56 and a duct 58.

As seen in FIG. 1, upon falling free of the endless belt 50, the raw, untrammeled coal 46 enters the bowl mill 14 by means of a hopper 56 and a duct 58, with which the separator body 32 is suitably provided. In accordance with the embodiment of the pulverizing bowl mill 14 illustrated in FIG. 1, the suitably dimensioned duct 58, has one end thereof extending outwardly from the separator body 32 and preferably terminates in the funnel-like hopper 56. The hopper 56 is suitably shaped so as to facilitate the collection of the raw, untrammeled coal 46 and to further the guiding of this coal 46 into one end of the duct 58. The other end of the duct 58 is operative to effect the discharge of the raw, untrammeled coal 46 onto the center portion of the surface of the grinding table 34. To this end, the duct 58 is suitably supported within the separator body 32 through the use of any suitable form of conventional support means (not shown). The duct 58 is coaxially aligned with the shaft 36 that supports the grinding table 34 for rotation, and is also located in coaxial relation to a classifier 60.

In accord with the mode of operation of pulverizing bowl mills that embody the form of construction depicted in FIG. 1, a gas 62 such as air, and commonly referred to as primary air, is utilized to effect the conveyance of the pulverized coal (not shown for clarity) from the grinding table 34 through the interior of the separator body 32 for discharge from the pulverizing bowl mill 14. The primary air 62 provided for this purpose enters the separator body 32 through a suitable opening 64 provided for this purpose. From this opening 64 the primary air 62 flows to a multiplicity of annular spaces 66 suitably formed between the periphery of the grinding table 34 and the inner wall surface of the separator body 32. The primary air 62 upon exiting from the annular spaces 66 is deflected over the grinding table 34 by means of suitably positioned deflector means (not shown). One such form of deflector means which is suitable for this purpose in the bowl mill 14 of FIG. 1 comprises the subject matter of U.S. Pat. No. 4,234,132 which issued on Nov. 18, 1980 to T. V. Maliszewski and which has been assigned to the same assignee as the present application.

While the primary air 62 is flowing along the path described above, the raw, untrammeled coal 46 which is now disposed upon the surface of the grinding table 34, though not shown in FIG. 1, is being pulverized by the action of the grinding rollers 42. As the raw, untrammeled coal 46 becomes pulverized, the particles of pulverized coal are thrown radially outward away from the center of the grinding table 34 by the effect of non-inertial (i.e., centrifugal) forces. Upon reaching the outer periphery of the grinding table 34, the particles of pulverized coal are entrained by the primary air 62 flowing through the annular spaces 66 and are carried along therewith in a combined flow hereinafter designated by the reference numeral 62' in FIG. 1. The combined flow 62' of primary air and pulverized coal particles is thereafter intercepted by the deflector means (not shown), which has been referred to above. The effect of this deflector interception is to cause the combined flow 62' of primary air and pulverized coal particles to be deflected over the grinding table 34. This necessitates a change in direction in the path of the combined flow 62' of pulverized coal particles and primary air. In the course of effecting this change in direction, the heaviest particles, possessing the most inertia, become separated from the combined flow 62' in a first stage separation and fall back to the surface of the grinding table 34 to suffer a second pulverizing action. The lighter coal particles, possessing less inertia, continue to be carried along in the combined flow 62'.

After leaving the influence of the aforesaid deflector means (not shown), the combined flow 62' of primary air and the remaining pulverized coal particles flow through a convoluted path to the classifier 60. The classifier 60 is in the nature of a rotary classifier in coaxial spaced relation to the vertical axis 40 and, in accord with conventional practice and in a manner well known to those skilled in the art, rotates thereabout so as to effect the further separation of still relatively heavy pulverized coal particles from the combined flow 62'. In particular, as is seen in FIG. 1, the rotary classifier 60 is operatively connected to a controllable motor drive means 70 via a conventional drive coupling means 72. The controllable motor drive means 70 is controllably driveable as a function of a demand 24 in the mass flow rate of output pulverized coal placed upon the bowl mill 14 by the aforesaid furnace control means (not shown). The rotational velocity of the rotary classifier 60 is correspondingly controlled via control of the driving speed of the motor drive means 70. By so adjusting the rotational velocity of the rotary classifier 60, those particles of pulverized coal, which are of a desired particle size, pass through the rotary classifier 60 and, continuing with the combined flow 62', are discharged therefrom and are thence discharged from the bowl mill 14 through the outlet 68 and thence delivered to the furnace 16 of the steam generating power plant 2. On the other hand, the inertia of those coal particles which in size are larger than desired causes the particles to fall to the surface of the grinding table 34 to undergo yet a second pulverizing action. Thereafter these coal particles are subject to a repetition of the process described above. That is, in a cyclic fashion, those particles which are returned to the grinding table 34 are again thrown outwardly from the center of the grinding table 34, are entrained by the primary air stream 62 exiting the annular spaces 66, and are deflected back to the surface of the grinding table 34 by the deflector means (not shown), whereupon the heavier particles again drop back to the surface of the grinding table 34 and the lighter particles are carried along to the classifier 60 whereupon those particles which are of a desired size pass therethrough and exit from the bowl mill 14 through the outlet 68. As a consequence of this cyclic action there is a buildup of pulverized coal particles within the bowl mill 14 during the steady state operation of the bowl mill 14. Such buildup of pulverized coal particles is herein referred to as a slug and further detailed below.

Figure 2:
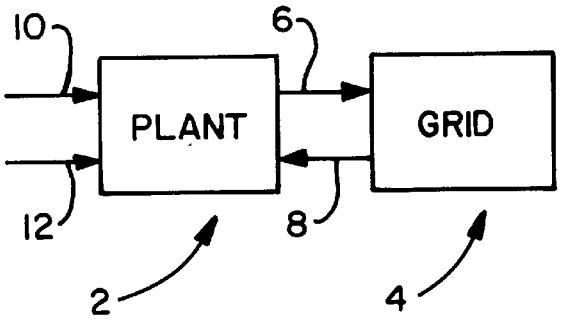
FIG. 2 is a schematic representation of a steam generating power plant and an electric power grid and the cooperative association therebetween capable of use in conjunction with the present invention.

In order to more fully grasp the nature and scope of the present invention it is deemed necessary to provide a fuller explanation of its operative background and setting. To that end reference is now had to FIG. 2. Therein depicted is a generalized schematic representation of a coal-fired steam generating power plant (PLANT) 2, an electric power grid (GRID) 4 and the cooperative association therebetween. Said cooperative association is depicted more particularly by the electric power 6 delivered to the electric power grid 4 from the steam generating power plant 2 and the demand 8 in electric power placed upon the steam generating power plant 2 by the electric power grid 4. Further depicted in FIG. 2 is the average mass flow feed rate of raw, untrammeled coal 46 delivered to the bowl mill 14 of the steam generating power plant 2, as depicted by reference numeral 10, and the average mass flow supply rate of primary air 62, also delivered to the bowl mill 14 of the steam generating power plant 2, as depicted by the reference numeral 1 2.

Figure 3:
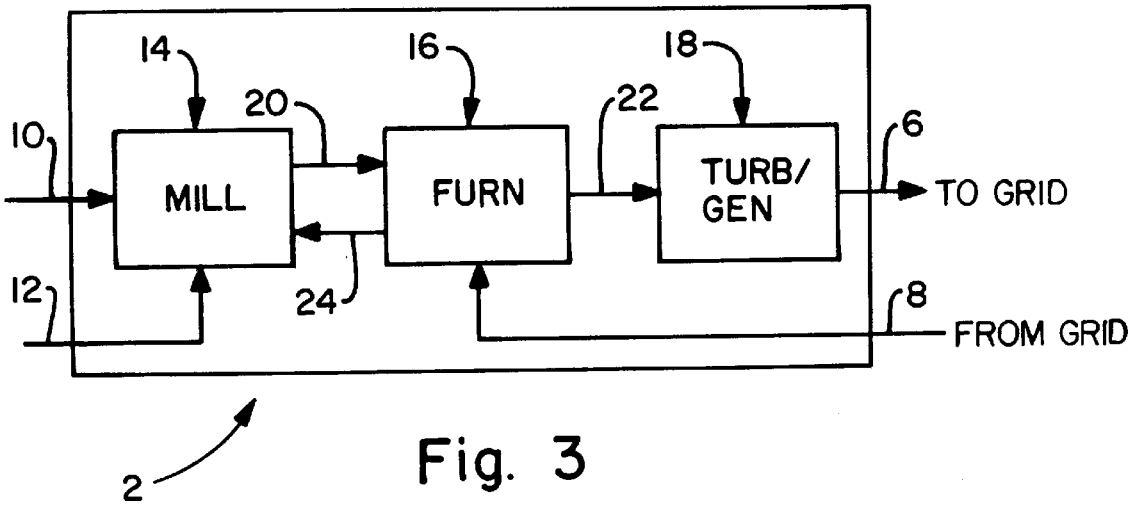
FIG. 3 is a more detailed schematic representation of the steam generating power plant of FIG. 2 as it is generally comprised of a bowl mill, a furnace and a turbine/generator set, and the cooperative association therebetween capable of use in conjunction with the present invention.

Referring now to FIG. 3 there is depicted, by way of exemplification and not limitation, and in greater detail, a schematic representation of the coal-fired steam generating power plant 2 as it is comprised of a bowl mill (MILL) 14, a furnace (FURN) 16, a turbine/generator set (TURB/GEN) 18 and the cooperative association therebetween. Said cooperative association is depicted more particularly by the mass flow rate 20 of output pulverized coal 62' delivered to the furnace 16 from the bowl mill 14, the mass flow rate 22 of output steam delivered to the turbine/generator set 18 from the furnace 16 and the demand 24 in mass flow rate of output pulverized coal placed upon the bowl mill 14 by the furnace 16.

With further reference to FIG. 3 it is to be understood therefrom that, by way of exemplification and not limitation, the demand 8 placed upon the steam generating power plant 2 by the electric power grid 4 is in the nature of a demand placed upon the furnace 1 6 of the steam generating power plant 2 and is delivered to a furnace control means (not shown for clarity). Said demand 8 is a demand for a change in the supply of output steam 22 of the furnace 16 and may be either a demand for more output steam 22 or a demand for less output steam 22 to be delivered to turbine/generator set 18 which thence respectively delivers more electric power 6 or less electric power 6 to the electric power grid 4.

It should also be understood from FIG. 3 that, upon receipt of the demand 8 placed upon the furnace 16 to satisfy a corresponding requirement of the electric power grid 4, the furnace control means, by virtue of its operative nature, in turn places a demand 24 in mass flow rate of output pulverized coal upon the bowl mill 14. As a consequence of the demand 24 in the mass flow rate of output pulverized coal placed upon the bowl mill 14, heretofore it has been the practice to simply increase or decrease the average mass flow feed rate 10 of raw, untrammeled coal 46 delivered to the bowl mill 14 coupled with an increase or decrease in the average mass flow supply rate 12 of primary air 62 delivered to the bowl mill 14 and to allow the rotational velocity of the rotary classifier 60 to adjust accordingly in order to maintain a preselected particle size distribution in the output pulverized coal delivered to the furnace 1 6. Due to the operative nature of the bowl mill 14, said increases or decreases in the mass flow rates 10, 12 of raw, untrammeled coal 46 and primary air 62 delivered to the bowl mill 14 respectively produce thereby a concomitant increase or decrease in the mass flow rate 20 of output pulverized coal delivered to the furnace 16 from the bowl mill 14 via the combined stream 62'. Due to the operative nature of the furnace 16, said increase or decrease in the mass flow rate 20 of output pulverized coal delivered to the furnace 16 from the bowl mill 14 via the combined stream 62' in turn produces thereby a concomitant increase or decrease in the mass flow rate 22 of output steam delivered to the turbine/generator set 18 from the furnace 16 from which there follows an increase or decrease in electric power 6 delivered thereby to the electric power grid 4 from the turbine/generator set 1 8.

Figure 4A:
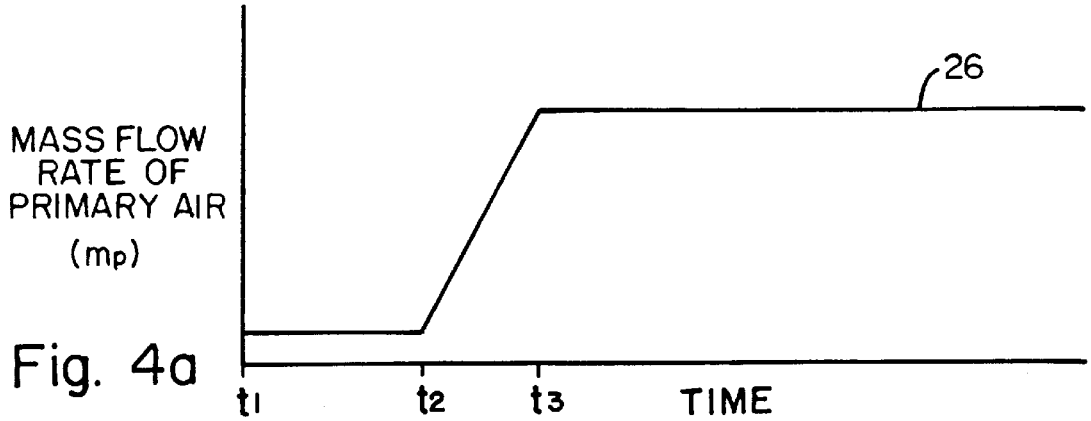
FIG. 4*a* is a first graphical representation of the dynamical characteristics of the mass flow rate of primary air delivered to a bowl mill as a function of time and capable of use in conjunction with the present invention.
Figure 4B:
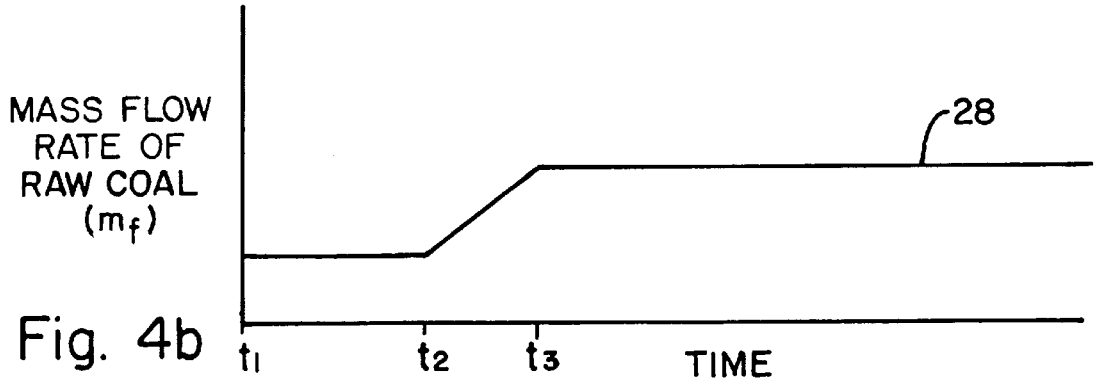
FIG. 4*b* is a first graphical representation of the dynamical characteristics of the mass flow rate of raw, untrammeled coal delivered to a bowl mill as a function of time and capable of use in conjunction with the present invention.
Figure 4C:
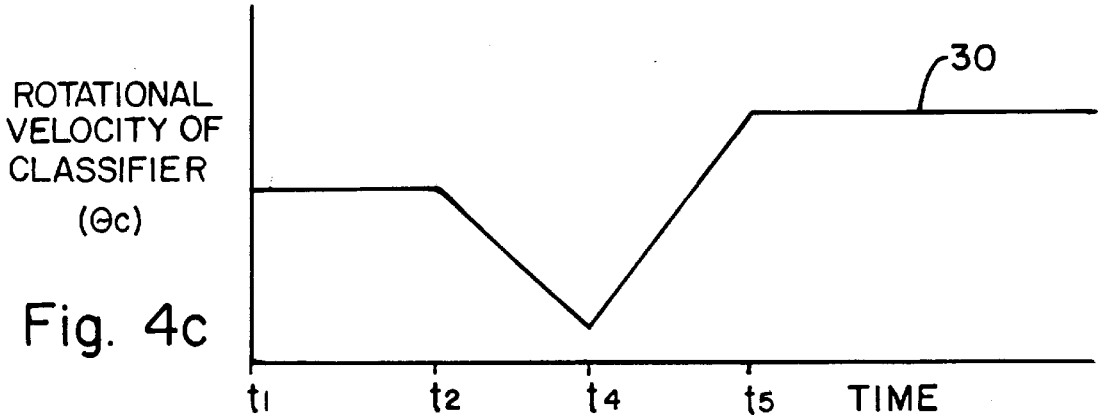
FIG. 4*c* is a first graphical representation of the dynamical characteristics of the rotational velocity of a dynamic classifier of a bowl mill as a function of time and capable of use in conjunction with the present invention.

With the above description of the construction and the mode of operation of a pulverizing bowl mill 14 and its operative setting and background as an introduction, reference is now made to FIGS. 4*a*, 4*b* and 4*c*. Therein depicted, by way of exemplification and not limitation, is a first graphical representation, in a superimposed fashion, of the mass flow supply rate 12 of primary air 62 fed to the bowl mill 14 as a function of time as designated by the reference numeral 26; the mass flow feed rate 10 of raw, untrammeled coal 46 fed to the bowl mill 14 as a function of time as designated by the reference numeral 28; and the rotational velocity of the rotary classifier 60 as a function of time as designated by the reference numeral 30. The aforesaid superimposition of the above graphical representations 26, 28, 30 is employed to emphasize the relative timing of the occurrence of certain conditions and dynamical events in the present invention.

It should be understood with reference to FIGS. 4*a*, 4*b*, and 4*c* that, in accordance with a first aspect of the present invention, said conditions and dynamical events occur for example, at least one bowl mill 14, in the following manner over a transition period spanning at least time $t_2$ to time $t_5$. During a first period, from $t_1$ to $t_2$, the bowl mill 14 is operated in a first steady state condition which is defined by a first average mass flow supply rate 12, of primary air 62 fed to the bowl mill 14; by a first average mass flow feed rate 10 of raw, untrammeled coal 46 fed to the bowl mill 14; and by a first average rotational velocity of the rotary classifier 60. During a second period, from $t_2$ to $t_3$ the average mass flow supply rate 12 of primary air 62 fed to the bowl mill 14 is increased to a greater average mass flow supply rate, the average mass flow feed rate 10 of raw, untrammeled coal 46 fed to the bowl mill 14 is increased to a greater average mass flow feed rate and the average rotational velocity of the rotary classifier 60 is decreased to a lesser average rotational velocity. After the third time, $t_3$, the average mass flow supply rate 12 of primary air 62 supplied to the bowl mill 14 is brought to a new average value and the average mass flow feed rate 10 of raw, untrammeled coal 46 supplied to the bowl mill 14 is brought to a new average value. At a fourth time, $t_4$, the rotational velocity of the rotary classifier 60 is increased. At a fifth time, $t_5$, the rotational velocity of the rotary classifier 60 is brought to a new average value whereupon the bowl mill 14 is now operating in a second steady state condition defined by a second average mass flow supply rate 12 of primary air 62 fed to the bowl mill 14, by a second average mass flow feed rate 10 of raw, untrammeled coal 46 fed to the bowl mill 14 and by a second average rotational velocity of the rotary classifier 60. As best understood with respect to the present invention it is such that during the time interval from $t_2$ to $t_4$, due to the decrease in the rotational velocity of the rotary classifier 60, the particle size distribution of that quantity of pulverized coal which passes through the rotary classifier 60 and is finally delivered to the furnace 1 6 of the steam generating power plant 2, changes, i.e., the fineness thereof also decreases. As a consequence of this decrease in the fineness of the pulverized coal passing through the rotary classifier 60 and due to the increase in the mass flow supply rate 12 of primary air 62 delivered to the bowl mill 14, that slug of pulverized coal (of a certain fineness) which has built up within the interior of the separator body 32 during the steady state operation of the bowl mill 14 is now allowed to pass through the rotary classifier 60 and be delivered to the furnace 14 of the steam generating power plant 2 in a relatively short period of time. By so allowing this slug of pulverized coal (of a certain fineness) to pass through the rotary classifier 60 in such a relatively short duration in time, the furnace 16 of the steam generating power plant 2 is capable of responding, in a relatively short period of time, to the demand 8 for an increase in the mass flow rate 22 of output steam placed upon the furnace 1 6 by an electric power grid 4.

With further reference to FIGS. 4*a,* 4*b,* and 4*c* it should be understood that, in accordance with a second aspect of the present invention, the method of operating a bowl mill 14, as described above, such that each of the above described conditions and dynamical events, at times $t_1$, $t_2$, $t_3$, $t_4$ and $t_5$, occurs for example in each bowl mill 14 of a plurality of bowl mills 14, simultaneously and in an en banc fashion, also allows the furnace 16 of the steam generating power plant 2 the capability of responding, in a relatively short period of time, to the demand 8 for an increase in the mass flow rate 22 of output steam placed upon the furnace 16 by an electric power grid 2.

Again with further reference to FIGS. 4*a,* 4*b,* and 4*c,* it should be understood that, in accordance with a third aspect of the present invention, the method of operating a bowl mill 14, as described with respect to the first aspect of the present invention, such that each of the above described conditions and dynamical events, at times $t_1$, $t_2$, $t_3$, $t_4$ and $t_5$, occurs for example in each bowl mill 14 of a plurality of bowl mills 14 beginning with a first bowl mill and proceeding sequentially therefrom to a second bowl mill, then to a third bowl mill and so on until each bowl mill, or as many bowl mills as is desired, of the plurality of bowl mills 14 has been so operated, also allows the furnace 16 of the steam generating power plant 2 the capability of responding, in a relatively short period of time, to the demand 8 for an increase in the mass flow rate 22 of output steam placed upon the furnace 16 by an electric power grid 4.

Figure 5A:
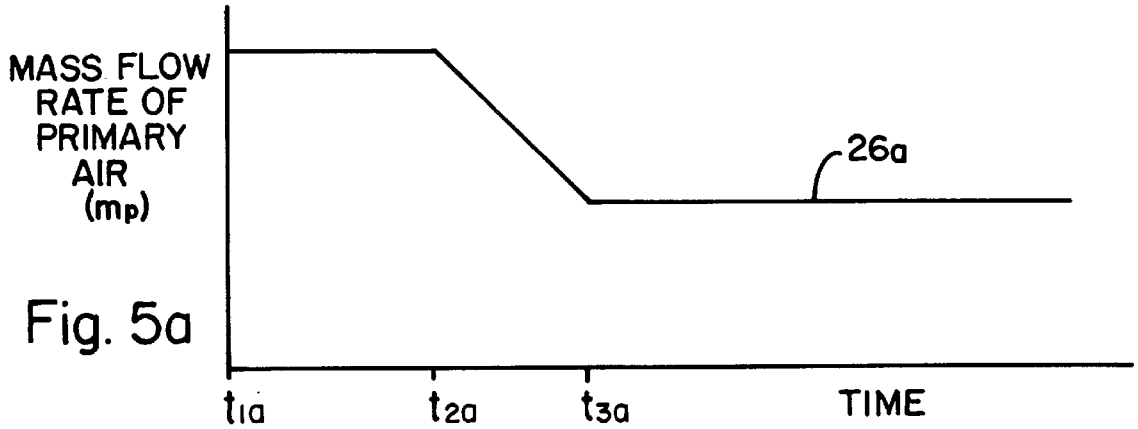
FIG. 5*a* is a second graphical representation of the dynamical characteristics of the mass flow rate of primary air delivered to a bowl mill as a function of time and capable of use in conjunction with the present invention.
Figure 5B:
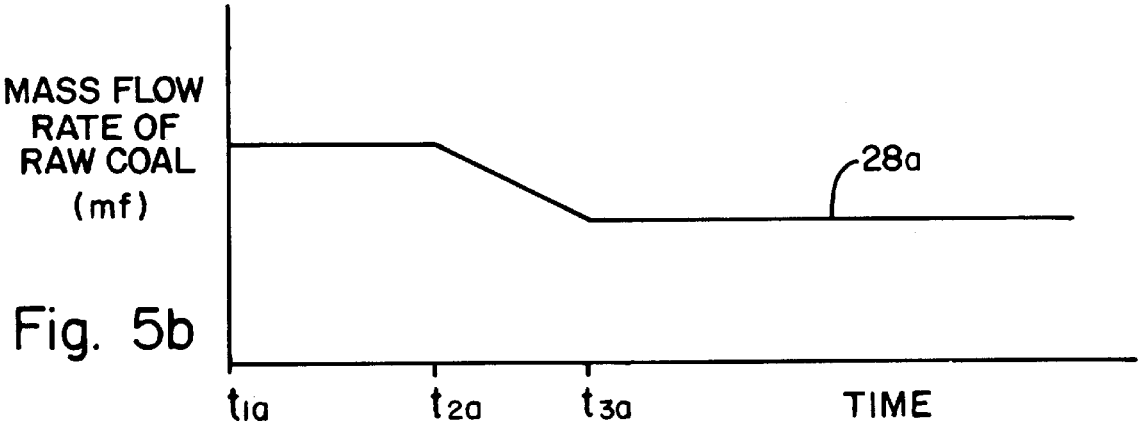
FIG. 5*b* is a second graphical representation of the dynamical characteristics of the mass flow rate of raw, untrammeled coal delivered to a bowl mill as a function of time and capable of use in conjunction with the present invention.
Figure 5C:
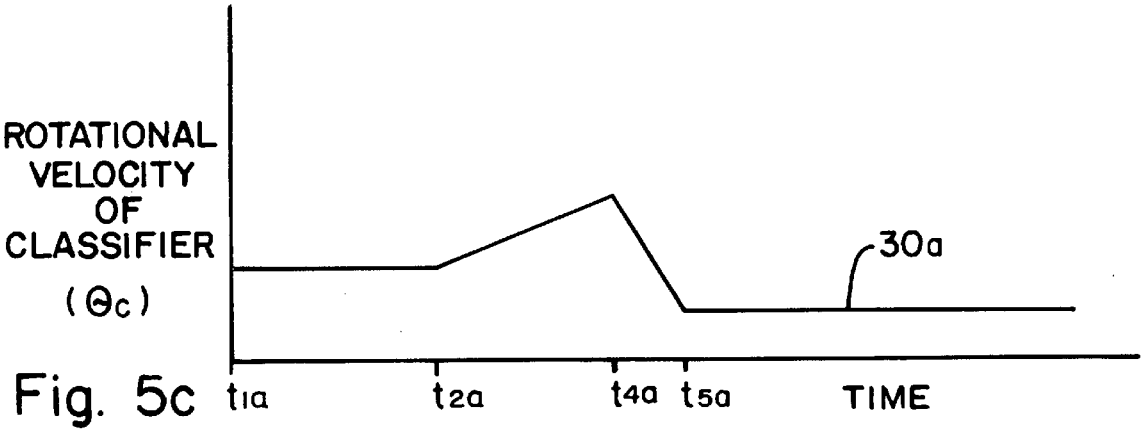
FIG. 5*c* is a second graphical representation of the dynamical characteristics of the rotational velocity of a dynamic classifier of a bowl mill as a function of time and capable of use in conjunction with the present invention.

Reference is now made to FIGS. 5*a,* 5*b* and 5*c.* Therein depicted, by way of exemplification and not limitation, is a second graphical representation, in a superimposed fashion, of the average mass flow supply rate 12 of primary air 62 fed to the bowl mill 14 as a function of time as designated by the reference numeral 26*a;* the average mass flow feed rate 10 of raw, untrammeled coal 46 fed to the bowl mill 14 as a function of time as designated by the reference numeral 28*a;* and the average rotational velocity of the rotary classifier 60 as a function of time as designated by the reference numeral 30*a.* The aforesaid superimposition of the above graphical representations 26*a,* 28*a,* 30*a* is employed to emphasize the relative timing of the occurrence of certain conditions and dynamical events in the present invention.

It should be understood with reference to FIGS. 5*a,* 5*b* and 5*c* that, in accordance with a fourth aspect of the present invention, said conditions and dynamical events occur for example, in at least one bowl mill 14, in the following manner over a transition period spanning at least time $t_{2a}$ to time $t_5$a. During a first period, from $t_{1a}$ to $t_{2a}$, the bowl mill 14 is operated in a first steady state condition which is defined by a first average mass flow supply rate 12, of primary air 62 fed to the bowl mill 14; by a first average mass flow feed rate 10 of raw, untrammeled coal 46 fed to the bowl mill 14; and by a first average rotational velocity of the rotary classifier 60. During a second period, from $t_{2a}$ to $t_{3a}$ the average mass flow supply rate 1 2 of primary air 62 fed to the bowl mill 14 is decreased to a lesser average mass flow supply rate, the average mass flow feed rate 10 of raw, untrammeled coal 46 fed to the bowl mill 14 is decreased to a lesser average mass flow feed rate and the average rotational velocity of the rotary classifier 60 is increased to a greater average rotational velocity. After the third time, $t_{3a}$, the average mass flow supply rate 12 of primary air 62 supplied to the bowl mill 14 is brought to a new average value and the average mass flow feed rate 10 of raw, untrammeled coal 46 supplied to the bowl mill 14 is brought to a new average value. At a fourth time, $t_{4a}$, the rotational velocity of the rotary classifier 60 is decreased. At a fifth time, $t_{5a}$, the rotational velocity of the rotary classifier 60 is brought to a new average value whereupon the bowl mill 14 is now operating in a second steady state condition defined by a second average mass flow supply rate 12 of primary air 62 fed to the bowl mill 14, by a second average mass flow feed rate 10 of raw, untrammeled coal 46 fed to the bowl mill 14 and by a second average rotational velocity of the rotary classifier 60. As best understood with respect to the present invention it is such that during the time interval from $t_{2a}$ to $t_{4a}$, due to the increase in the rotational velocity of the rotary classifier 60, the particle size distribution of that quantity of pulverized coal which passes through the rotary classifier 60 and is finally delivered to the furnace 16 of the steam generating power plant 2, changes, i.e., the fineness thereof also increases. As a consequence of this increase in the fineness of the pulverized coal passing through the rotary classifier 60 and due to the decrease in the mass flow supply rate 1 2 of primary air 62 delivered to the bowl mill 14, a lesser quantity of pulverized coal is allowed to pass through the rotary classifier 60 to be delivered to the furnace 16 of the steam generating power plant 2. This diminution in the amount of pulverized coal delivered to the furnace 16 occurs over a relatively short period of time. This allows the furnace 16 of the steam generating power plant 2 to be capable of responding, in a relatively short period of time, to the demand 8 for a decrease in the mass flow rate 22 of output steam placed upon the furnace 16 by an electric power grid 4.

With further reference to FIGS. 5*a,* 5*b* and 5*c* it should be understood that, in accordance with a fifth aspect of the present invention, the method of operating a bowl mill 14, as described above, such that each of the above described conditions and dynamical events, at times $t_{1a}$, $t_{2a}$, $t_{3a}$, $t_{4a}$ and $t_{5a}$, occurs for example in each bowl mill 14 of a plurality of bowl mills 14, simultaneously and in an en banc fashion, also allows the furnace 16 of the steam generating power plant 2 the capability of responding, in a relatively short period of time, to the demand 8 for an decrease in the mass flow rate 22 of output steam placed upon the furnace 16 by an electric power grid 2.

Again with further reference to FIGS. 5*a,* 5*b* and 5*c,* it should be understood that, in accordance with a sixth aspect of the present invention, the method of operating a bowl mill 14, as described with respect to the first aspect of the present invention, such that each of the above described conditions and dynamical events, at times $t_{1a}$, $t_{2a}$, $t_{3a}$, $t_{4a}$ and $t_{5a}$, occurs for example in each bowl mill 14 of a plurality of bowl mills 14 beginning with a first bowl mill and proceeding sequentially therefrom to a second bowl mill, then to a third bowl mill and so on until each bowl mill, or as many bowl mills as is desired, of the plurality of bowl mills 14 has been so operated, also allows the furnace 16 of the steam generating power plant 2 the capability of responding, in a relatively short period of time, to the demand 8 for an decrease in the mass flow rate 22 of output steam placed upon the furnace 1 6 by an electric power grid 4.

Figure 6:
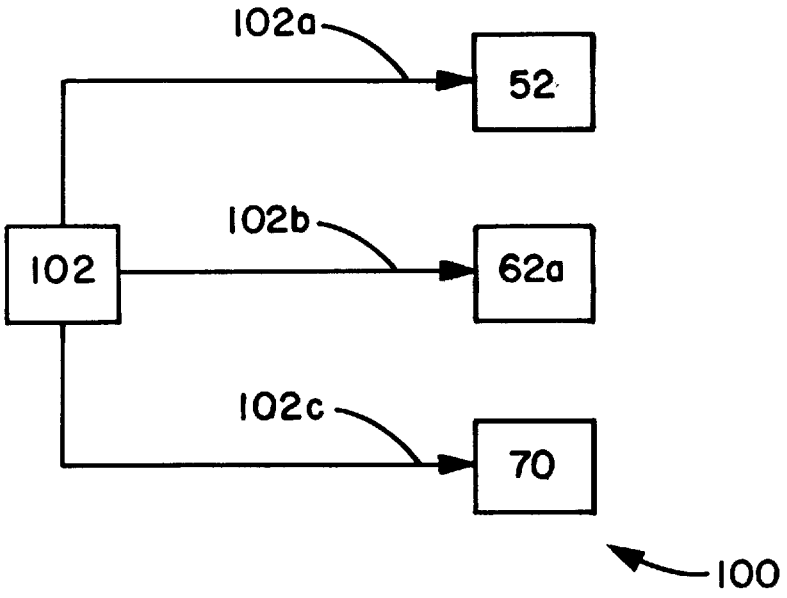
FIG. 6 is a generalized schematic diagram of a control system for controlling the operation of the mass flow rate of primary air delivered to a bowl mill, the mass flow rate of raw, untrammeled coal delivered to a bowl mill and the rotational velocity of a dynamic classifier of a bowl mill in a coordinated manner and in conjunction with the method of the present invention.

Reference is now made to FIG. 6. Therein depicted, by way of exemplification and not limitation, is a control system 100 for controlling, in accordance with the method of the present invention, the operation of at least one pulverizer acting in cooperative association with a fuel-fired steam generating power plant. Said control system 100 comprises a controller 102 in signal communication with the rollers 52, the controllable gas supply source 62*a* and the controllable motor drive means 70 by way of signal paths designated by the reference numeral 102*a,* 102*b* and 102*c*.

Thus, in accordance with the present invention there has been provided a new and improved method of controlling the operation of a bowl mill such that the furnace of a steam generating power plant can more rapidly respond to abrupt changes in the demands place upon the output of the furnace due to the abrupt changes in the power requirements of an electric power grid.

In addition, in accordance with the present invention there has been provided such a new and improved method of controlling the operation of a bowl mill such that the method is capable of use in conjunction with each bowl mill of a plurality of bowl mills operating simultaneously and in an en banc fashion.

Furthermore, in accordance with the present invention there has been provided such a new and improved method of controlling the operation of a bowl mill such that the method is capable of use in conjunction with each bowl mill of a plurality of bowl mills beginning with a first bowl mill and proceeding sequentially therefrom to a second bowl mill and so on until each bowl mill, or as many bowl mills as desired, of the plurality of bowl mills has been so operated.

Still further, in accordance with the present invention there has been provided such a new and improved method of controlling the operation of a bowl mill such that the method is capable of use in conjunction with numerous different types of pulverizers.

While several embodiments of the present invention have been disclosed, it will be appreciated that modifications thereto, some of which have been alluded to herein, may still be readily made by those skilled in the art. We therefore intend by the appended claims to cover the modifications alluded to herein as well as all other modifications that fall within the true spirit and scope of our invention.

What is claimed is:

1. A method for controlling the operation of at least one pulverizer acting in cooperative association with a fuel-fired steam generating power plant which includes a furnace and the at least one pulverizer embodying therewithin a grinding area in which solid fuel is pulverized and a rotary classifier means for classifying the pulverized solid fuel between a discharge condition in which some of the pulverized solid fuel is suitable for discharge from the at least one pulverizer to the furnace and a non-discharge condition in which the remaining pulverized solid fuel is retained in the at least one pulverizer for further pulverizing, said method comprising the steps of:

I. operating the at least one pulverizer in an initial operating condition so as to establish thereby a first mass flow rate of output pulverized solid fuel delivered to the furnace and a first particle size distribution thereof including:

a. feeding raw, untrammeled solid fuel to the at least one pulverizer at an initial average mass flow feed rate for pulverization of the solid fuel in the pulverizer;

b. supplying a gas stream to the at least one pulverizer at an initial average mass flow supply rate, the gas stream entraining at least some of the pulverized solid fuel for flow thereof into engagement with the rotary classifier means for classification thereby;

c. rotating the rotary classifier means at an initial average rotational velocity to classify the pulverized solid fuel between the discharge condition and the non-discharge condition; and II. during a transition period changing the operation of the at least one pulverizer from the initial operating condition so as to establish thereby a second mass flow rate of output pulverized solid fuel delivered to the furnace and a second particle size distribution thereof including:

a. increasing the average mass flow feed rate of the raw, untrammeled solid fuel being fed to the at least one pulverizer to an increased average mass flow feed rate;

b. increasing the average mass flow supply rate of the gas stream being supplied to the at least one pulverizer to an increased average mass flow supply rate; and c. decreasing the average rotational velocity of the rotary classifier means to a decreased average rotational velocity, wherein the second mass flow rate of the pulverized solid fuel to the furnace is greater than the first mass flow rate of the pulverized solid fuel to the furnace and the second particle size distribution is such that the second particle size distribution contains a greater percentage of relatively larger particles than the first particle size distribution.

2. The method of claim 1 wherein the step of changing the operation of the at least one pulverizer from an initial operating condition includes the step of increasing the average rotational velocity of the rotary classifier means to an increased average rotational velocity.

3. The method of claim 2 wherein the step of changing the operation of the at least one pulverizer includes the step of simultaneously changing the operation of a plurality of pulverizers.

4. The method of claim 3 wherein the step of changing the operation of a plurality of pulverizers includes the step of changing the operation of a first pulverizer thereof and by proceeding sequentially therefrom successively changing the operation of each pulverizer of the plurality of pulverizers.

5. The method of claim 4 wherein the step of changing the operation of a plurality of pulverizers includes the step of changing the operation of a first pulverizer thereof and by proceeding sequentially therefrom successively changing the operation of some of the pulverizers of the plurality of pulverizers.

6. The method of claim 4 wherein the step of changing the operation of a plurality of pulverizers includes the step of changing the operation of a first pulverizer thereof and by proceeding sequentially therefrom successively changing the operation of each pulverizer of the plurality of pulverizers.

7. The method of claim 6 wherein the step of changing the operation of a plurality of pulverizers includes the step of changing the operation of a first pulverizer thereof and by proceeding sequentially therefrom successively changing the operation of some of the pulverizers of the plurality of pulverizers.

8. A method for controlling the operation of at least one pulverizer acting in cooperative association with a fuel-fired steam generating power plant which includes a furnace and the at least one pulverizer embodying therewithin a grinding area in which solid fuel is pulverized and a rotary classifier means for classifying the pulverized solid fuel between a discharge condition in which some of the pulverized solid fuel is suitable for discharge from the at least one pulverizer to the furnace and a non-discharge condition in which the remaining pulverized solid fuel is retained in the at least one pulverizer for further pulverizing, said method comprising the steps of:

I. operating the at least one pulverizer in an initial operating condition so as to establish thereby a first mass flow rate of output pulverized solid fuel delivered to the furnace and a first particle size distribution thereof including:

a. feeding raw, untrammeled solid fuel to the at least one pulverizer at an initial average mass flow feed rate for pulverization of the solid fuel in the pulverizer;

b. supplying a gas stream to the at least one pulverizer at an initial average mass flow supply rate, the gas stream entraining at least some of the pulverized solid fuel for flow thereof into engagement with the rotary classifier means for classification thereby;

c. rotating the rotary classifier means at an initial average rotational velocity to classify the pulverized solid fuel between the discharge condition and the non-discharge condition; and II. during a transition period changing the operation of the at least one pulverizer from the initial operating condition so as to establish thereby a second mass flow rate of output pulverized solid fuel delivered to the furnace and a second particle size distribution thereof including:

a. decreasing the average mass flow feed rate of the raw, untrammeled solid fuel being fed to the at least one pulverizer to a decreased average mass flow feed rate;

b. decreasing the average mass flow supply rate of the gas stream being supplied to the at least one pulverizer to a decreased average mass flow supply rate; and c. increasing the average rotational velocity of the rotary classifier means to an increased average rotational velocity, wherein the second mass flow rate of the pulverized solid fuel to the furnace is greater than the first mass flow rate of the pulverized solid fuel to the furnace and the second particle size distribution is such that the second particle size distribution contains a greater percentage of relatively larger particles than the first particle size distribution.

9. The method of claim 6 wherein the step of changing the operation of the at least one pulverizer from an initial operating condition includes the step of decreasing the average rotational velocity of the rotary classifier means to a decreased average rotational velocity.

10. The method of claim 9 wherein the step of changing the operation of the at least one pulverizer includes the step of simultaneously changing the operation of a plurality of pulverizers.

11. A system for controlling the operation of at least one pulverizer acting in cooperative association with a fuel-fired steam generating power plant which includes a furnace and the at least one pulverizer embodying therewithin a grinding area in which solid fuel is pulverized and a rotary classifier means for classifying the pulverized solid fuel between a discharge condition in which some of the pulverized solid fuel is suitable for discharge from the at least one pulverizer to the furnace and a nondischarge condition in which the remaining pulverized solid fuel is retained in the at least one pulverizer for further pulverizing, said system comprising:

a. means for feeding raw, untrammeled solid fuel to the at least one pulverizer;

b. means for supplying a gas stream to the at least one pulverizer;

c. means for rotating the rotary classifier means;

d. control means in signal communication with said means for feeding raw, untrammeled solid fuel to the at least one pulverizer, means for supplying a gas stream to the at least one pulverizer and means for rotating the classifier means;

whereby said means for feeding raw, untrammeled solid fuel to the at least one pulverizer is operative to feed raw, untrammeled solid fuel thereto at an initial average mass flow feed rate for pulverization therein;

said means for supplying a gas stream to the at least one pulverizer is operative to supply a gas stream thereto at an initial average mass flow supply rate, the gas stream entraining at least some of the pulverized solid fuel for flow thereof into engagement with the rotary classifier means for classification thereby;

said means for rotating the rotary classifier means is operative to rotate the rotary classifier means at an initial average rotational velocity to classify the pulverized solid fuel between the discharge condition and the non-discharge condition;

so as to establish thereby a first mass flow rate of output pulverized solid fuel delivered to the furnace and a first particle size distribution thereof; and whereby said means for feeding raw, untrammeled solid fuel to the at least one pulverizer is operative to increase the average mass flow feed rate of the raw, untrammeled solid fuel being fed to the at least one pulverizer to an increased average mass flow feed rate;

said means for supplying a gas stream to the at least one pulverizer is operative to increase the average mass flow supply rate of the gas stream being supplied to the at least one pulverizer to an increased average mass flow supply rate; and said means for rotating the rotary classifier means is operative to decrease the average rotational velocity of the rotary classifier means to a decreased average rotational velocity, so as to establish thereby a second mass flow rate of output pulverized solid fuel delivered to the furnace and a second particle size distribution thereof wherein the second mass flow rate of the pulverized solid fuel to the furnace is greater than the first mass flow rate of the pulverized solid fuel to the furnace and the second particle size distribution is such that the second particle size distribution contains a greater percentage of relatively larger particles than the first particle size distribution.

* * * * *